United States Patent [19]

Schatz et al.

[11] 4,283,824

[45] Aug. 18, 1981

[54] METHOD FOR MANUFACTURING HEAT EXCHANGER TUBING

[75] Inventors: Friedrich Schatz; Gerhard Ziemek, both of Langenhagen, Fed. Rep. of Germany

[73] Assignee: Kabel-und Metallwerke Gutehoffnungshuette AG, Hanover, Fed. Rep. of Germany

[21] Appl. No.: 68,707

[22] Filed: Aug. 22, 1979

[30] Foreign Application Priority Data

Aug. 25, 1978 [DE] Fed. Rep. of Germany ..... 2837184

[51] Int. Cl.[3] ..... B23P 15/26

[52] U.S. Cl. ..... 29/157.4; 72/366; 72/368; 29/727; 29/157.3 R; 138/38; 138/177; 165/148

[58] Field of Search ..... 72/366, 368; 29/157.4, 29/726, 727, 157.3 D, 157.3 R; 138/177, 38, 40; 165/148

[56] References Cited

U.S. PATENT DOCUMENTS

| | | | |
|---|---|---|---|
| 1,363,416 | 12/1920 | Hooker | 29/157.4 |
| 1,761,980 | 6/1930 | Bundy | 29/157.4 |
| 2,420,992 | 5/1947 | Wilson | 29/727 |

*Primary Examiner*—Daniel C. Crane
*Assistant Examiner*—V. K. Rising
*Attorney, Agent, or Firm*—Martin A. Farber

[57] ABSTRACT

In accordance with the teachings of the instant invention, methods and apparatus are set forth for the manufacture of discrete lengths of heat exchanger tubing comprised of a thin walled metallic tubular member having a plurality of spaced apart transverse grooves impressed into its outer surface, and expanded end portions whose inner cross sections form symmetrical polygons. Such tubing is manufactured in accordance with the instant invention by the steps of deforming a metal band in a longitudinal direction into a tubular member, continuously seam welding the longitudinal edges of the tubular member, continuously impressing spaced apart grooves into the outer surface of the welded tubular member, transversely cutting the tubular member along smooth portions of the tubular member between selected adjacent transverse grooves to form discrete tube lengths, and expanding the inner cross sections of the end portions of each of such lengths to form symmetrical polygons.

4 Claims, 5 Drawing Figures

FIG. 1
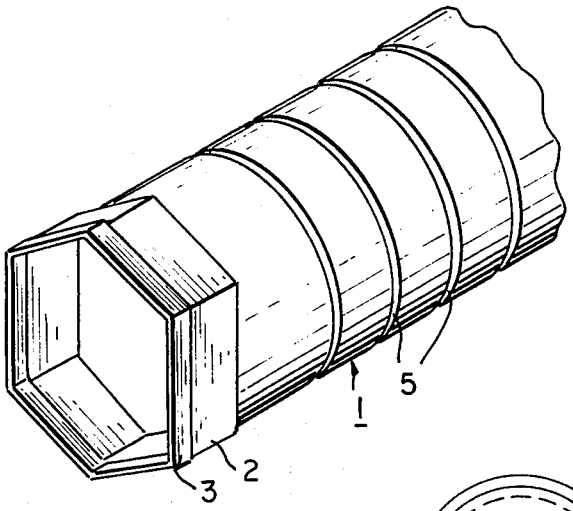
FIG. 2
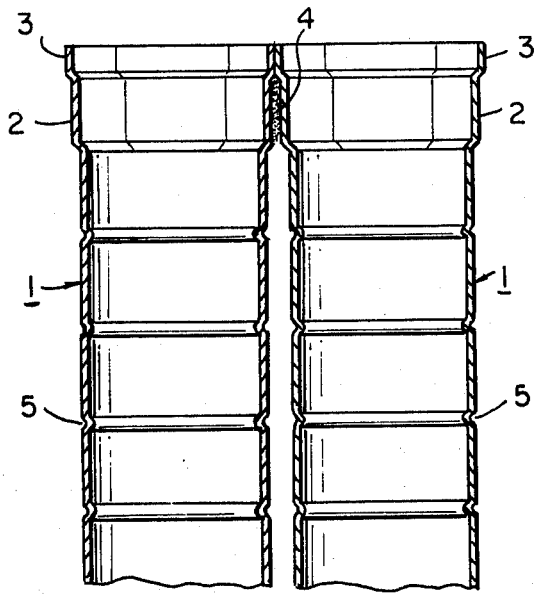
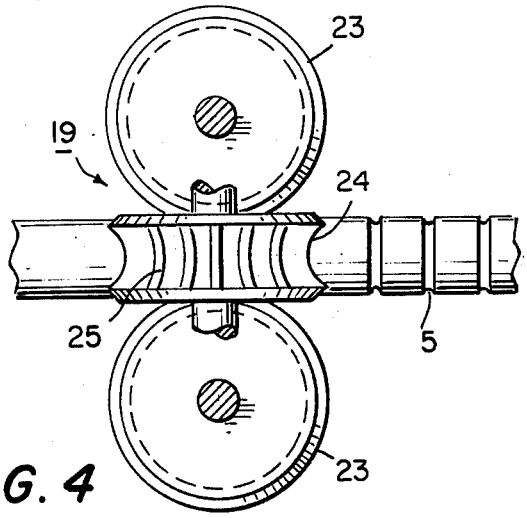
FIG. 4
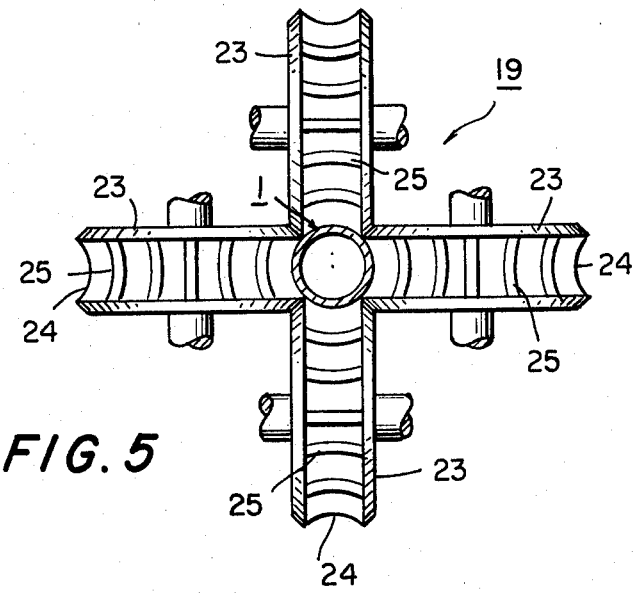
FIG. 5

METHOD FOR MANUFACTURING HEAT EXCHANGER TUBING

The invention relates to methods and apparatus for the manufacture of discrete lengths of heat exchanger tubing each comprised of a thin walled, metallic tubular member having a plurality of spaced apart transverse grooves impressed into its outer surface, and expanded end portions whose inner cross sections form symmetrical polygons.

It has been proposed to use a certain type of heat exchanger tubing for the fabrication of heat exchanger arrays that may be used for cooling heated water derived from power generated turbines. Such type of heat exchanger tubing is configured so as to have its end portions widened into a hexagonal shape extending beyond the outer surface of the remaining portion of the tubing, and having the outer surface of such remaining portion impressed with spaced apart transverse grooves.

To form a heat exchanger array, it has been proposed that a plurality of such heat exchanger tubings be positioned parallel to each other, side by side, with their immediately adjacent sides of their hexagonal end portions soldered together. Upon the passage of heated water from a power station into the heat exchanger array, the outer surfaces of the plurality of heat exchanger tubings are surrounded by the hot water, heat is conducted through the respective thin walls of such tubings, and air which flows axially through such tubings absorbs the thermal energy from the interior surfaces of the tubings. The impressed grooves into the outer surfaces of the heat exchanger tubings provide extensions into the interior volumes of the tubings which create turbulent air conditions within the tubings for improved heat transfer.

It is an object of the present invention to provide an improved method and apparatus for the economic manufacture of such heat exchanger tubing. Such method and apparatus involve the techniques of continuously forming and longitudinally seam welding a metal band or strip into a tubular member, impressing spacially separated transverse grooves into certain portions of the tubular member, while other portions remain smooth or without grooves, and then cutting the tubular member in preselected nongrooved portions to form discrete lengths of such tubing. Additionally, the end portions of such discrete lengths are expanded by the insertion of a conical mandrel to form end portions into a symmetrical polygon.

The method of the present invention permits the manufacture of the aforesaid type tubing from relatively thin metal bands, thus saving material and increasing heat conductivity. For example, such tubing with only 0.5 mm wall thickness, an outer diameter of 20 mm, and transverse grooves impressed to a depth of 0.8 mm and spaced apart by a 23 mm separation in the grooved portion of the tubing, have been economically manufactured at speeds in excess of 20 meters per minute.

Another aspect of the present invention involves the welded seam area of the heat exchanger tubing being cooled after the welding and the microstructure of material in the welded seam area being changed by cold working. This procedure increases the strength of the material in the welded seam area to at least 95% of the strength of the material of the metal band.

The invention will be more clearly understood by reference to the following detailed description of an exemplary embodiment thereof, in conjunction with the accompanying drawings in which:

FIG. 1 is an isometric view of a length of heat exchanger tubing manufactured in accordance with the techniques of the instant invention.

FIG. 2 is a side elevation sectional view of two lengths of heat exchanger tubing that may be joined together to form an array of heat exchanger tubings.

Figure 3:
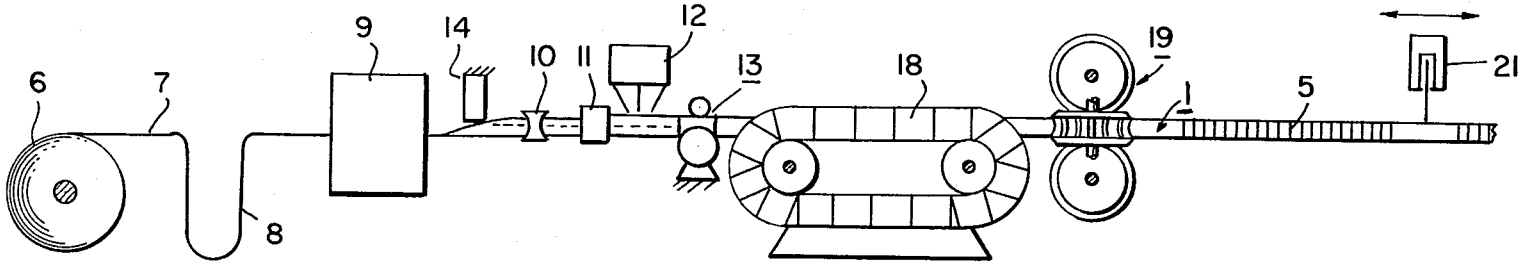

FIG. 3 schematically illustrates an exemplary embodiment for the manufacture of extended lengths of heat exchanger tubing in accordance with the teachings of the instant invention.

FIG. 4 is a side elevation view, of the groove forming apparatus of the Turk's head type and FIG. 5 is an end elevation view, of the groove forming apparatus of the Turk's head type, employed in the embodiment illustrated in FIG. 3, for impressing transverse grooves into the outer surface of the heat exchanger tubing manufactured in accordance with the instant invention.

FIG. 1 illustrates a heat exchanger tubing 1 made of thin aluminum strip of 0.5 mm thickness, and having an outer diameter of about 20 mm. An end portion 2 of the tubing 1 has an expanded hexagonal cross section with an even slightly wider bead 3 at the extreme edge. The bead 3 permits solder to enter the cavity 4 between a pair of adjacent tubings 1, as shown in FIG. 2. Each of the heat exchanger tubings 1 has spaced apart transverse grooves 5 impressed into its outer surfaces to a depth of about 0.85 mm for the purpose of causing a turbulent condition when air flows axially through the tubing.

FIG. 2 illustrates the manner in which two of a large plurality of heat exchanger tubings 1 are to be joined together to form a heat exchanger array. The cavity 4 between the adjacent tubings 1 in the area of the hexagonal end portions 2 is filled with solder and, therefore, sealed for the longitudinal passage of, for example, water to be cooled between the outer surfaces of each of the heat exchanger tubings 1. As the water to be cooled engages the outer surfaces of the various heat exchanger tubings 1, heat is conducted through their respective thin metallic walls to their respective inner surfaces. Air passing axially within each of the heat exchanger tubings 1 impinges upon the extension of the impressed grooves 5 in the inner wall surfaces of the tubes, the extension creating a high turbulence condition which optimizes the air flow absorption of heat from such inner surfaces.

FIG. 3 schematically illustrates apparatus for manufacturing the heat exchanger tubing 1. As therein depicted, a pay-off supply 6 continuously feeds aluminum strip material 7 through a trip accumulator 8 and a strip degreaser 9. In a manner priorly known, the strip accumulator 8 provides a compensating means for interruptions in the constant longitudinal movement of the strip material 7, while the strip degreaser 9 includes a vapor of an organic solvent that is employed to remove foreign surface deposits from the strip material 7. The degreased strip material 7 is fed through tube forming tools 10 which shape the strip 7 into a tubular configuration having a longitudinal gap between its longitudinal edges. Such separated longitudinal edges are drawn together in a closing die 11 and butt welded immediately thereafter under a polyarc torch of a welding station 12. Behind the welding station 12 there is provided a cold working roller mechanism 13 which is of a design to cold work the welded seam to increase its strength to at least 95% of that strength of the strip material 7. A lubrication emulsion is injected by a feed device 14 between the separated longitudinal edges of the tube before the closing die 11 to act as coolant for the subsequently generated welded seam area (and also, as lubricant to reduce the friction between a conical mandrel (not shown) to be subsequently inserted into the end portions of discrete lengths of exchanger tubing 1 for expanding the interior cross sections thereof to form symmetrical hexagons). Behind the cold working mechanism 13 there is provided a split clamp capstan drive 18 which engages the welded tube, pulls it from the welding station 12 and directs it into the groove forming apparatus 19.

FIGS. 4 and 5 illustrate the groove forming apparatus 19 which is of the Turk's head type comprising four tube deforming wheels 23 angularly spaced from each other by 90°. Each of the tube deforming wheels 23 has a plurality of spaced apart transverse ridges 25 extending out from its circumferential groove surface 24. The transverse grooves 5 in the outer surface of the heat exchanger tubing 1, are generated by impressing the ridges 25 into the outer surface of the tubing 1 as it passes through an aperture defined by the combination of merging circumferential groove surfaces 24 of the deforming wheels 23. The cross sectional shape of the aperture defined by the combination of merging circumferential groove surfaces 24 of the deforming wheels 23 may (by appropriate selection of the shape of such groove surfaces 24) be circular and in conformance with the outer circumference of the longitudinally moving tubing 1, or may be slightly hexagonal for imparting a similar shape to the tubing for aiding the subsequent step of expanding the end portions to form symmetrical hexagons. Preferably, the circumference of each of the tube deforming wheels 23 is chosen so that one turn of each of such wheels applies all transverse grooves 5 to a predetermined length of tubing 1, and also permits a certain portion of such length of tubing to remain free of grooves. This may be achieved by having the transverse ridges 25 spaced apart equidistantly over only a part of the circumferential groove surface 24, preferably over only ¾ of the circumference of such surface. The transverse cutting of the heat exchanger tubing 1 into predetermined lengths is achieved by a saw mechanism 21 axially positioned downstream of the groove forming apparatus 19, which is adapted to move longitudinally and to cut transversely across a non-grooved section of the heat exchanger tubing 1. The resulting lengths of heat exchanger tubings 1 are then brought to a device (not shown) where the inner cross sections of the end portions thereof are expanded, by the insertion of a conical mandrel, to form symmetrical hexagons.

While the invention has been described in conjunction with a single exemplary embodiment thereof, it will be understood that many modifications will be readily apparent to those of ordinary skill in the art; and that this application is intended to cover any adaptations or variations thereof. Therefore, it is manifestly intended that this invention be limited only by the claims and equivalents thereof.

We claim:

1. A method for manufacturing heat exchanger tubing having a plurality of spaced apart transverse grooves impressed into its outer surfaces, comprising the steps of:

deforming a metal band in a longitudinal direction into a tubular member;

continuously welding the longitudinal edges of said tubular member to form a tubular member having a longitudinally welded seam;

continuously impressing spaced apart transverse grooves into the outer surface of said welded tubular member by means of a groove forming roller means;

transversely cutting said tubular member along smooth portions of said tubular member between adjacent transverse grooves to provide discrete tube lengths; and expanding the interior cross section of the end portions of each of said tube lengths to form a symmetrical polygon each side of which is positioned in a radial direction beyond the outer surface of the portion of said tube length between said end portions.

2. The menthod in accordance with claim 1 wherein the interior cross section of each of said end portions of each of said tube lengths is widened to form a symmetrical hexagon.

3. The method in accordance with claim 1 additionally comprising the steps of cooling and cold working the material in the welded seam area of said tubular member for changing the microstructure of such material to increase its strength to at least 95% of the strength of said metal band.

4. The method in accordance with claim 1, wherein said continuous welding step is achieved by a multiarc welding at a speed in excess of 20 meters of tube length per minute.

* * * * *